US011377878B1

(12) United States Patent
Cheung

(10) Patent No.: US 11,377,878 B1
(45) Date of Patent: Jul. 5, 2022

(54) SAFETY STORAGE FURNITURE

(71) Applicant: OFFICE ANGUNSA CO., LTD., Seoul (KR)

(72) Inventor: Yong Ju Cheung, Paju-si (KR)

(73) Assignee: OFFICE ANGUNSA CO., LTD., Seoul (KR)

( * ) Notice: Subject to any disclaimer, the term of this patent is extended or adjusted under 35 U.S.C. 154(b) by 0 days.

(21) Appl. No.: 17/318,817

(22) Filed: May 12, 2021

(30) Foreign Application Priority Data

Mar. 25, 2021 (KR) ..... 10-2021-0038859

(51) Int. Cl.
*E05B 65/463* (2017.01)
*A47B 88/50* (2017.01)
*A47B 97/00* (2006.01)

(52) U.S. Cl.
CPC ..... *E05B 65/463* (2013.01); *A47B 88/50* (2017.01); *A47B 2097/008* (2013.01)

(58) Field of Classification Search
CPC ..... E05B 65/462; E05B 65/463; A47B 88/50; A47B 2210/0086; A47B 2097/008
See application file for complete search history.

(56) References Cited

U.S. PATENT DOCUMENTS 3,888,558 A * 6/1975 Himsl ..... E05B 65/463 312/216
4,865,404 A * 9/1989 Harper ..... E05B 65/463 312/221

FOREIGN PATENT DOCUMENTS

| | | | | |
|---|---|---|---|---|
| DE | 574228 C | * | 4/1933 | ..... E05B 65/463 |
| EP | 0574373 A1 | * | 12/1993 | ..... E05B 65/463 |
| GB | 2170993 A | * | 8/1986 | ..... E05B 65/463 |
| KR | 20-0248077 Y1 | | 10/2001 | |
| KR | 20-0283281 Y1 | | 7/2002 | |
| KR | 10-0767096 B1 | | 10/2007 | |
| KR | 20-0458806 Y1 | | 3/2012 | |

* cited by examiner

*Primary Examiner* — Andrew M Roersma
(74) *Attorney, Agent, or Firm* — Rabin & Berdo, P.C.

(57) ABSTRACT

The present disclosure relates to a safety storage furniture, and an object of the present disclosure is to provide safety storage furniture, in which a locking unit having a locking groove provided on one side surface of a drawer and a guide unit having an inclined guide and a horizontal guide are integrally connected and installed, such that an assembly property of the storage furniture may be improved and extended and locked states of the drawer may be smoothly maintained.

5 Claims, 11 Drawing Sheets

SAFETY STORAGE FURNITURE

CROSS-REFERENCE TO RELATED APPLICATIONS

This application claims the priority of Korean Patent Application No. 10-2021-0038859 filed on Mar. 25, 2021, in the Korean Intellectual Property Office, the disclosure of which is incorporated herein by reference.

BACKGROUND

Field

The present disclosure relates to a safety storage furniture, and more particularly, to a safety storage furniture, in which a locking guide having a locking groove and a guide rail is conveniently installed on a lateral surface of a drawer, such that drawers of file boxes or other multi-stage storage furnitures may be smoothly extended and locked, and an assembly property and durability of the drawer may be improved by a simple structure and convenient installation of the locking guide.

Description of the Related Art

In general, a drawer-type storage furniture is widely used at home and office in order to store and accommodate storage objects such as various types of documents or various types of clothes. The drawer-type storage furniture is configured to store various types of objects and clothes in a plurality of drawers which is opened or closed by sliding.

A drawer-type storage furniture used in the related art is configured such that a single locking device installed at an upper side of the storage furniture locks all the drawers to prevent the extension of the drawers or release all the drawers to allow the extension of the drawers. For this reason, when a user extends the plurality of drawers at the same time, the entire storage furniture may roll over due to the weights of the objects and clothes accommodated in the drawers, which may threat the user's safety.

In particular, if a child plays while climbing up the drawers in a state in which the plurality of drawers is extended, the child may fall down when the storage furniture rolls over, which may cause a very severe accident.

In addition, in order to prevent an accident caused by the simultaneous extension of the drawers, there has been proposed a method of installing locking devices on the respective drawers to control the extension of the respective drawers. However, this method may only prevent the safety accident that may be caused by the children but may not be used as a basic solution because the drawers are extended simultaneously in a state in which a user unlock all the drawers.

Of course, there is a storage furniture having a configuration for preventing the simultaneous extension of the drawers, but the storage furniture in the related art configured to prevent the simultaneous extension of the drawers has a complicated structure and a comparatively unstable operational structure. For this reason, the storage furniture is damaged when the drawers are repeatedly extended and retracted.

In particular, the configuration in the related art for preventing the simultaneous extension of the drawers cannot be applied to the furniture already produced, and as a result, there are various problems in that it is impossible to prevent the safety accident caused by the furniture that has been produced and sold.

SUMMARY

An object to be achieved by the present disclosure is to provide a safety storage furniture, in which when one drawer is extended, the other drawer is automatically kept locked, such that it is possible to prevent a rollover of the storage furniture caused when the plurality of drawers is simultaneously extended.

Another object to be achieved by the present disclosure is to provide a safety storage furniture, in which a locking unit having a locking groove provided on one side surface of a drawer and a guide unit having an inclined guide and a horizontal guide are integrally connected and installed, such that an assembly property of the storage furniture may be improved and extended and locked states of the drawer may be smoothly maintained.

Still another object to be achieved by the present disclosure is to provide a safety storage furniture that has a simple structure and may be easily applied, without a structural change, to furniture already produced and having drawers, thereby improving safety of the storage furniture.

According to an aspect of the present disclosure, a safety storage furniture according to the present disclosure includes: a storage furniture main body having an internal space opened in a forward direction; a plurality of drawers installed to be extended from and retracted into the internal space of the storage furniture main body; a locking guide installed on one side surface of the drawer; and a locking support having a plurality of locking members and vertically installed on one side inner surface of the storage furniture main body so as to correspond to the locking guide, in which the locking guide has a guide unit and a locking unit which are integrally configured, the guide unit changes a height of the locking member in an upward/downward direction while moving in a state in which the guide unit is in contact with the locking member of the locking support, and the locking unit is provided at a front end of the guide unit so as to be connected to the guide unit and has a locking groove into which the locking member of the locking support is inserted and coupled.

According to the present disclosure, the safety storage furniture has the simple structure in which the locking unit having the locking groove and the locking guide, which has the guide unit having the inclined guide and the horizontal guide integrally connected, are installed on one side surface of the drawer. As a result, the number of components required for the storage furniture may be reduced, the unit price of the product may be reduced in accordance with the reduction in manufacturing costs, and the assembly and installation processes may be easily performed.

According to the present disclosure, when one drawer is extended, the other drawer is kept locked by the locking guide. As a result, it is possible to prevent a rollover of the storage furniture and safety accident caused when a user inadvertently extends the drawer.

In addition, according to the present disclosure, since the locking unit and the guide unit are integrally provided, durability of the locking guide may be constantly maintained even when the storage furniture is used over a long period of time, and thus operation reliability may be improved.

According to the present disclosure, the safety storage furniture may be easily applied, without a structural change, to the furniture already produced. It is possible to prevent a safety accident caused by the furniture that has already been sold, and thus it is possible to improve consumer satisfaction.

According to the present disclosure, since the locking member of the locking support has the plurality of grooves, the frictional force caused by the contact between the locking member and the guide unit of the locking guide at the time of extending the drawer is reduced. As a result, the occurrence of noise may be reduced, thereby improving operational performance.

According to the present disclosure, since the locking groove has the locking support surface inclined upward in the rearward direction, the locking member is securely coupled into the locking groove by the locking support surface when the drawer is forcibly extended in the locked state of the drawer. As a result, it is possible to assuredly prevent the drawer from being forcibly extended.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
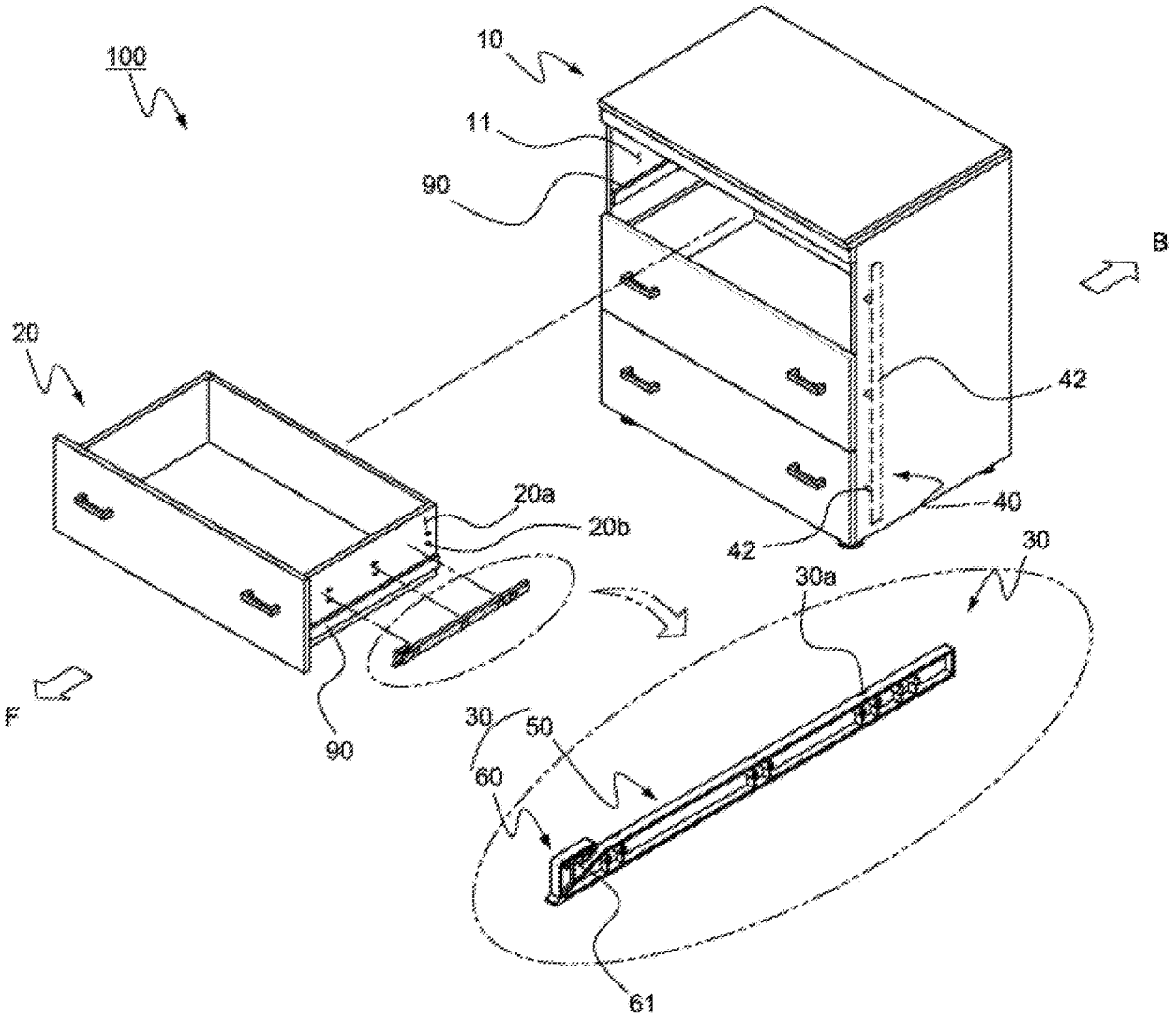
FIG. 1 is an exemplified view illustrating a configuration according to the present disclosure.
Figure 2:
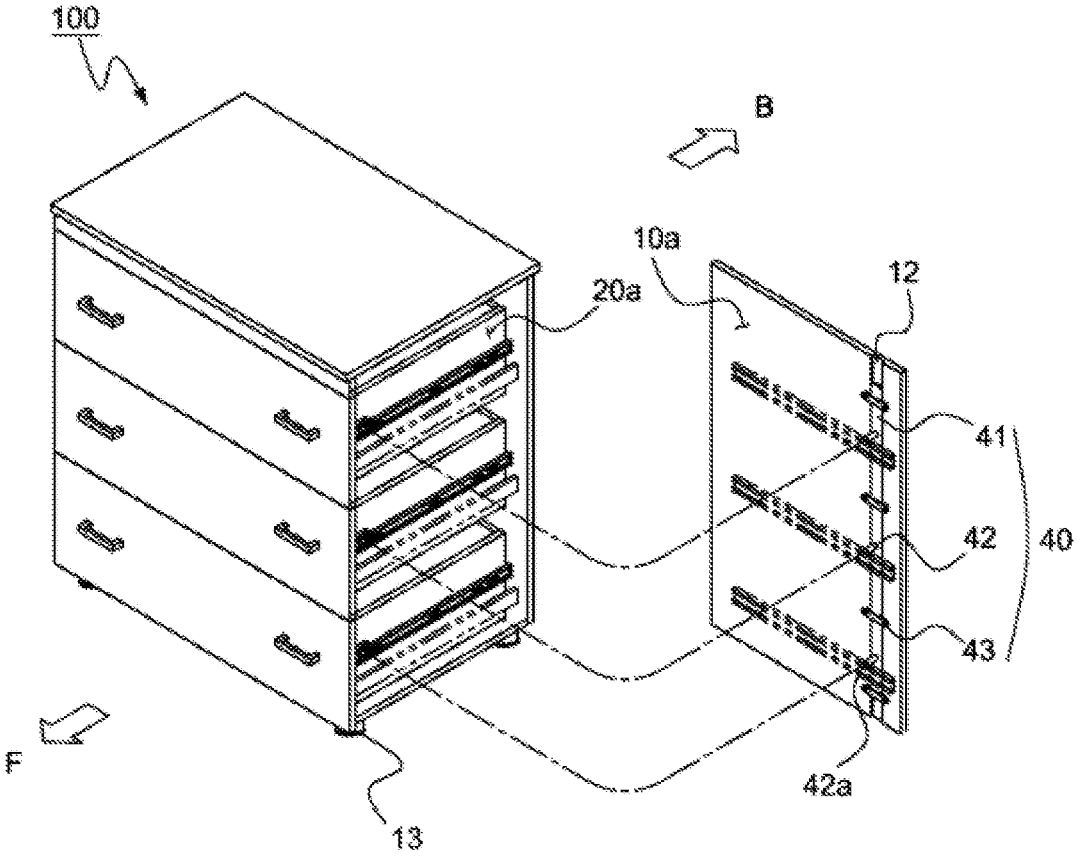
FIG. 2 is an exemplified view illustrating an internal configuration of a storage furniture according to the present disclosure.
Figure 3:
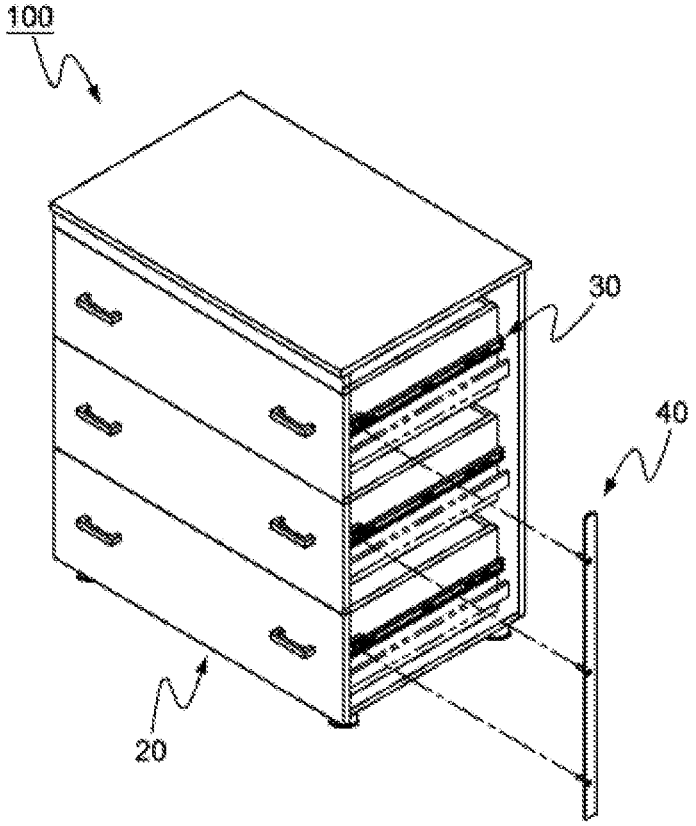
FIG. 3 is an exemplified view illustrating an assembly relationship between a locking guide and a locking support according to the present disclosure.
Figure 4:
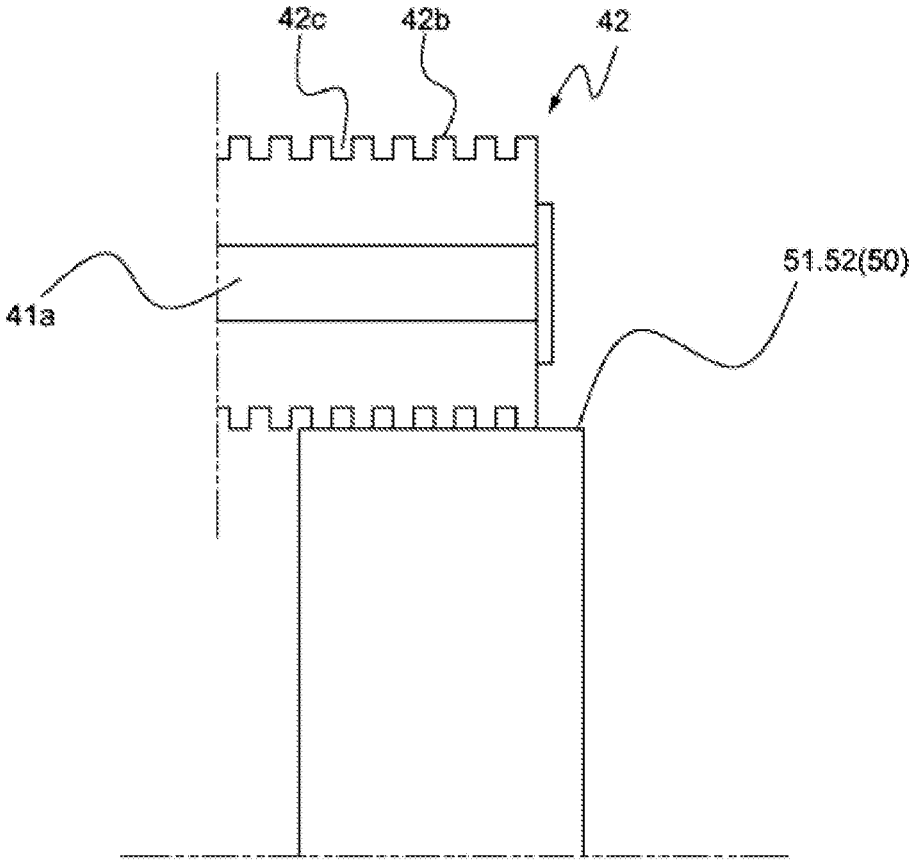
FIG. 4 is an exemplified view illustrating a configuration of a locking member of the locking support according to the present disclosure.
Figure 5:
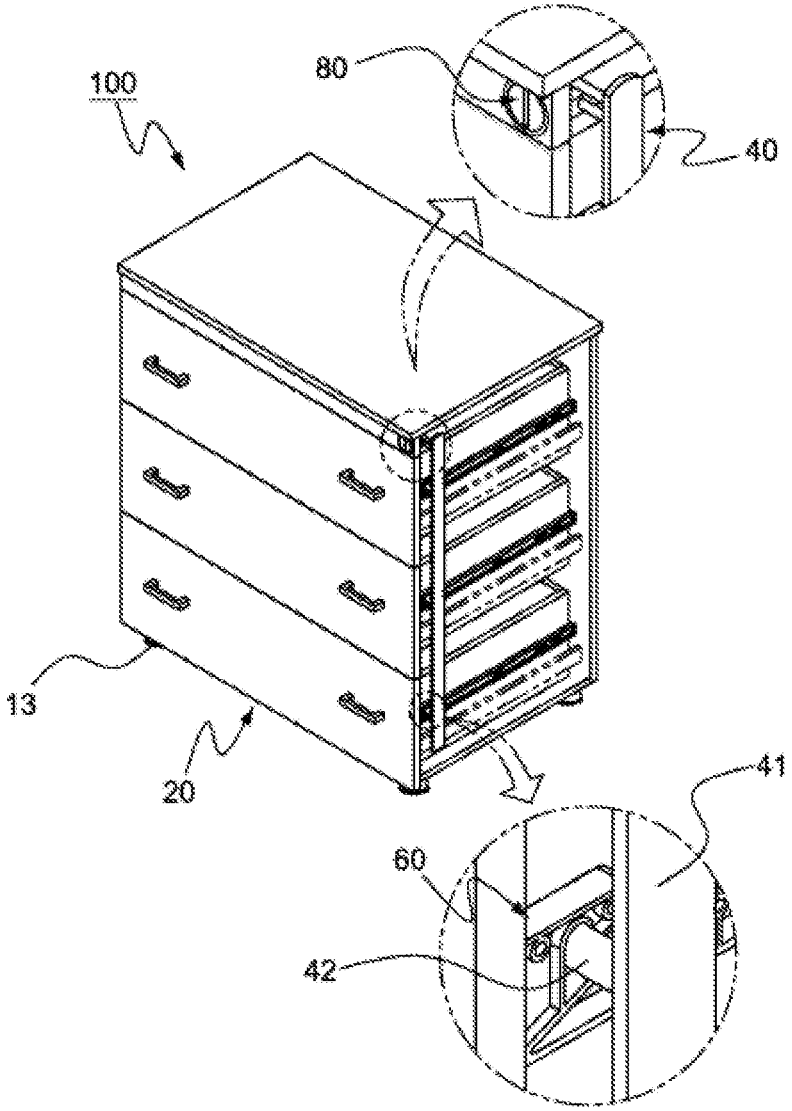
FIG. 5 is an exemplified view illustrating a state in which the storage furniture according to the present disclosure is locked.
Figure 6:
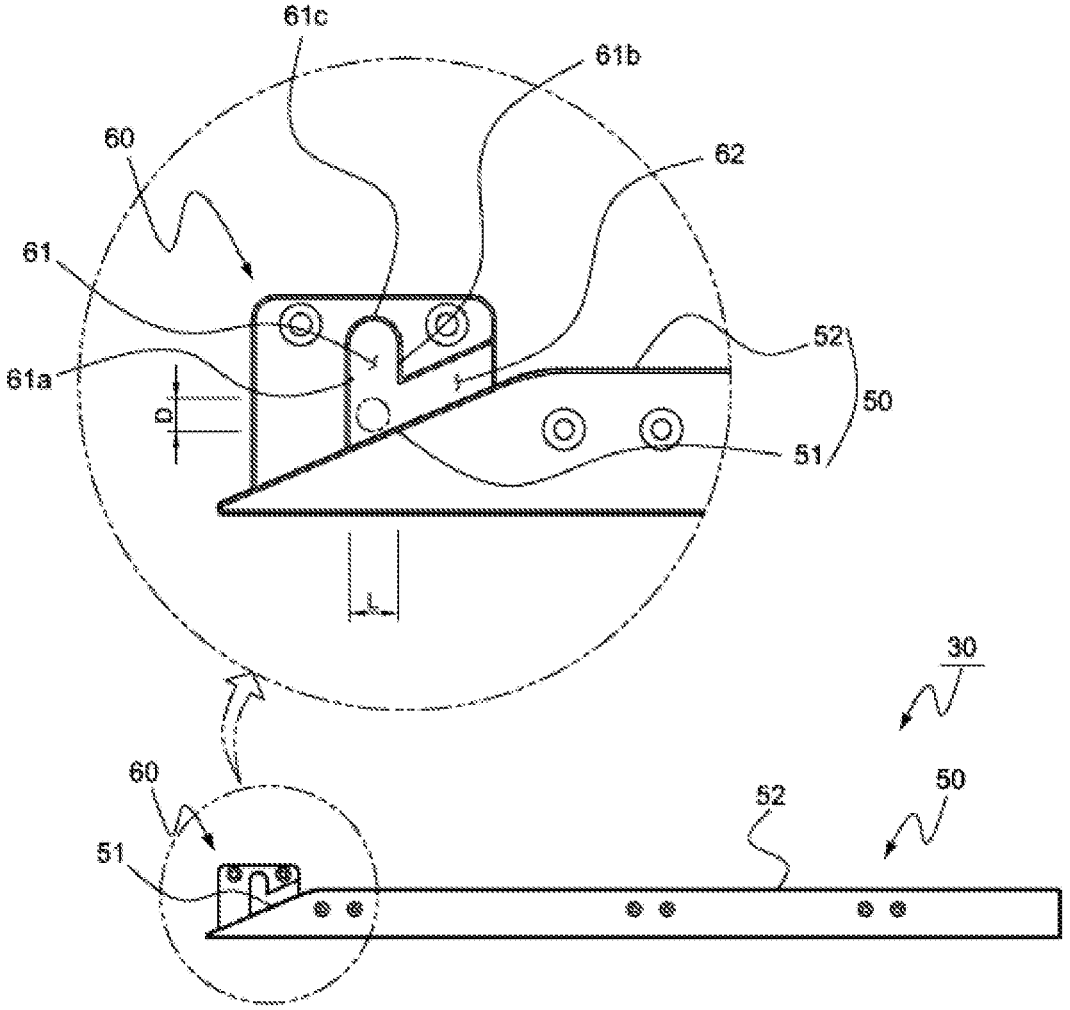
FIG. 6 is an exemplified view illustrating a configuration of the locking guide according to the present disclosure.
Figure 7:
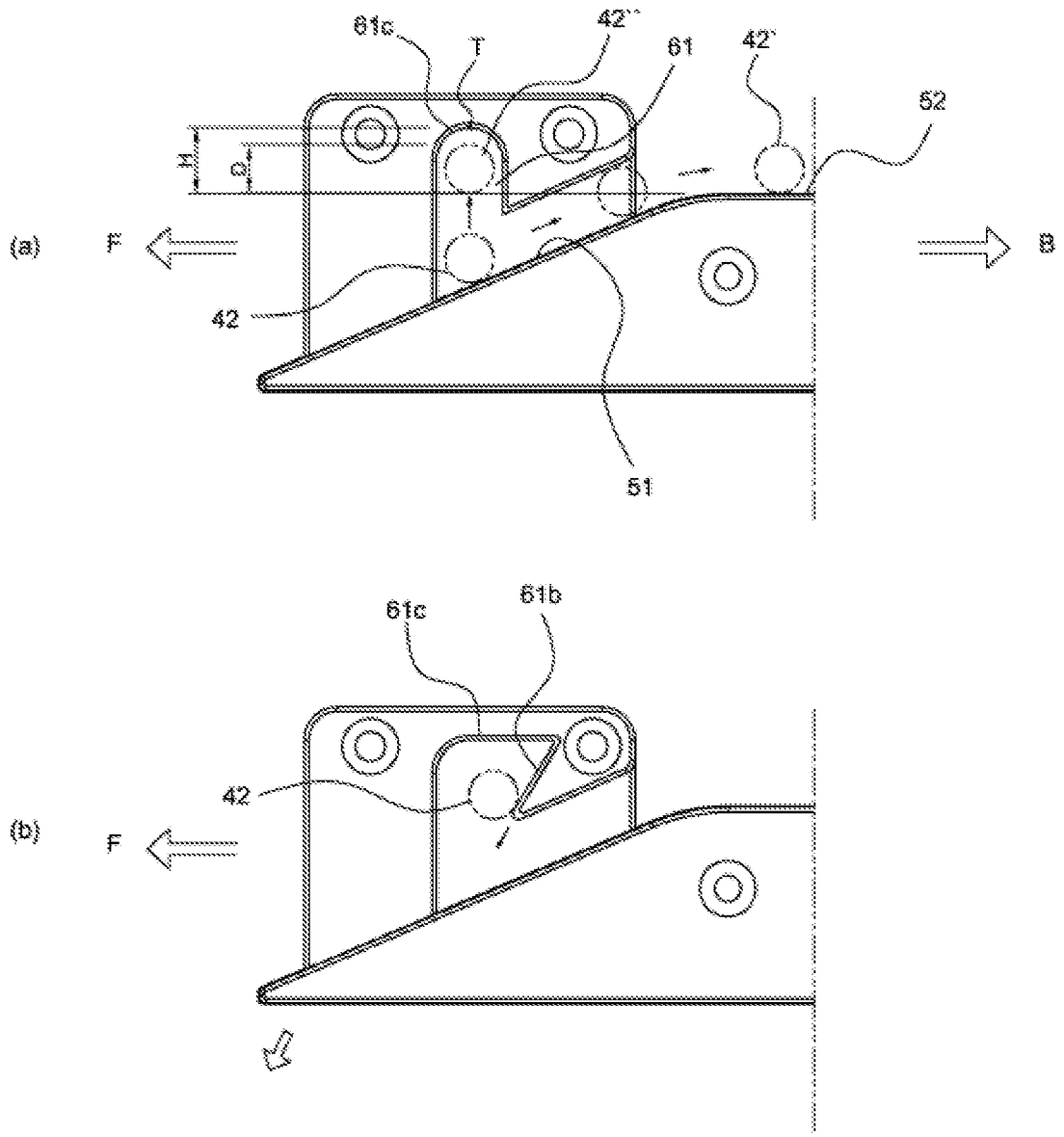
FIG. 7 is an exemplified view illustrating detailed configurations of a guide unit and a locking unit according to the present disclosure.
Figure 8:
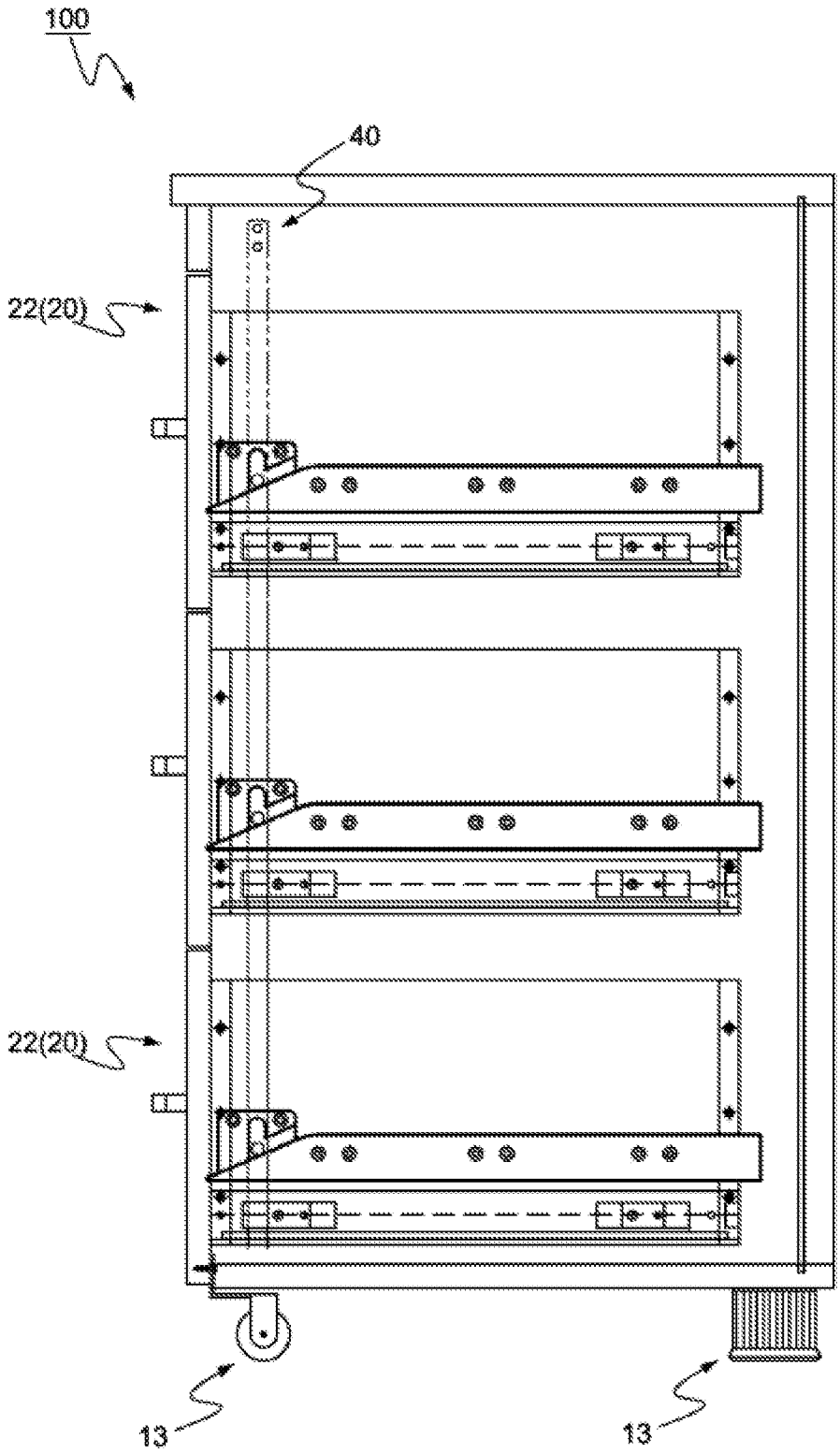
FIG. 8 is an exemplified view illustrating a state in which a drawer is coupled to a storage furniture main body according to the present disclosure.
Figure 9:
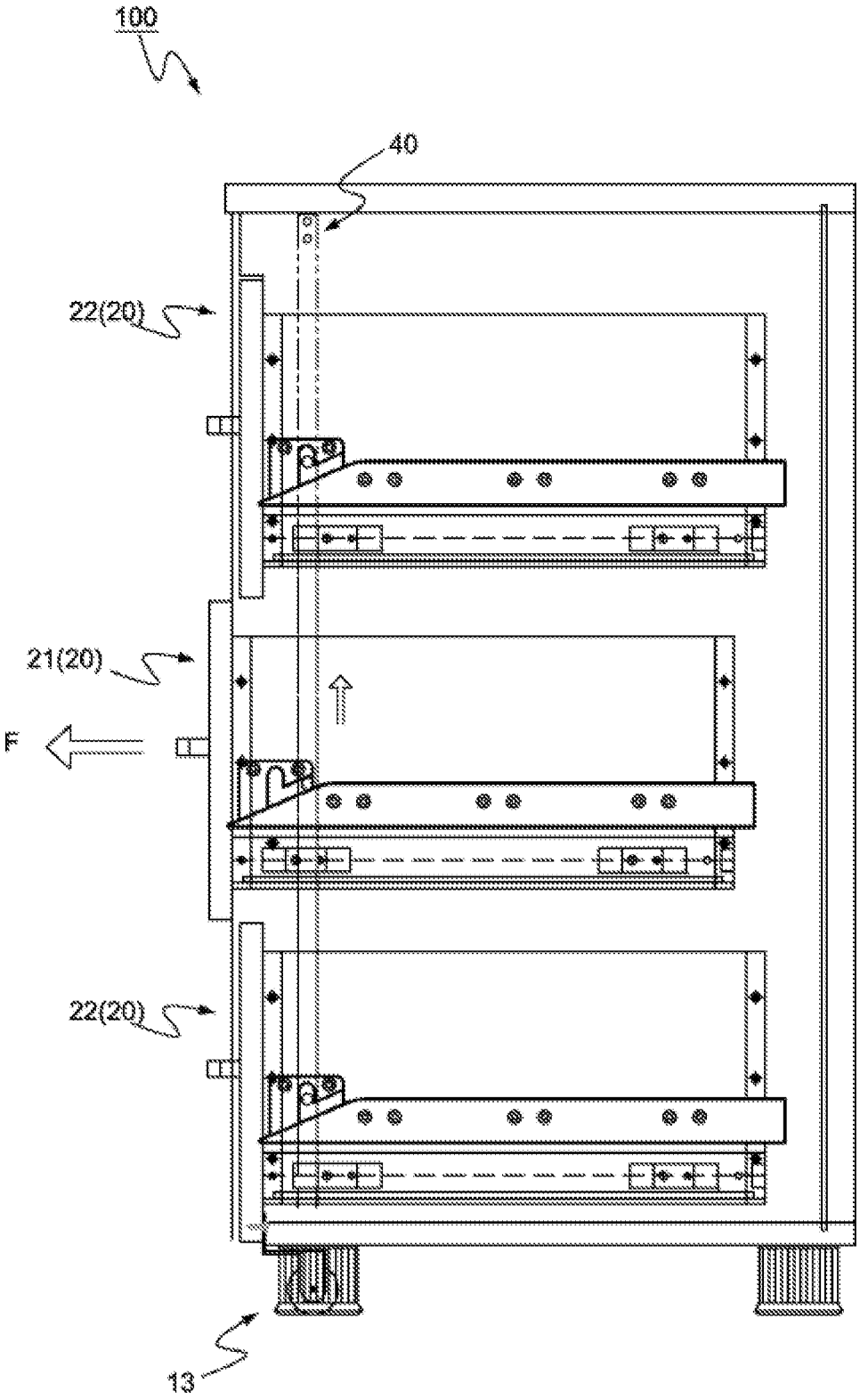
FIG. 9 is an exemplified view illustrating a state in which one drawer is extended from the storage furniture main body according to the present disclosure.
Figure 10:
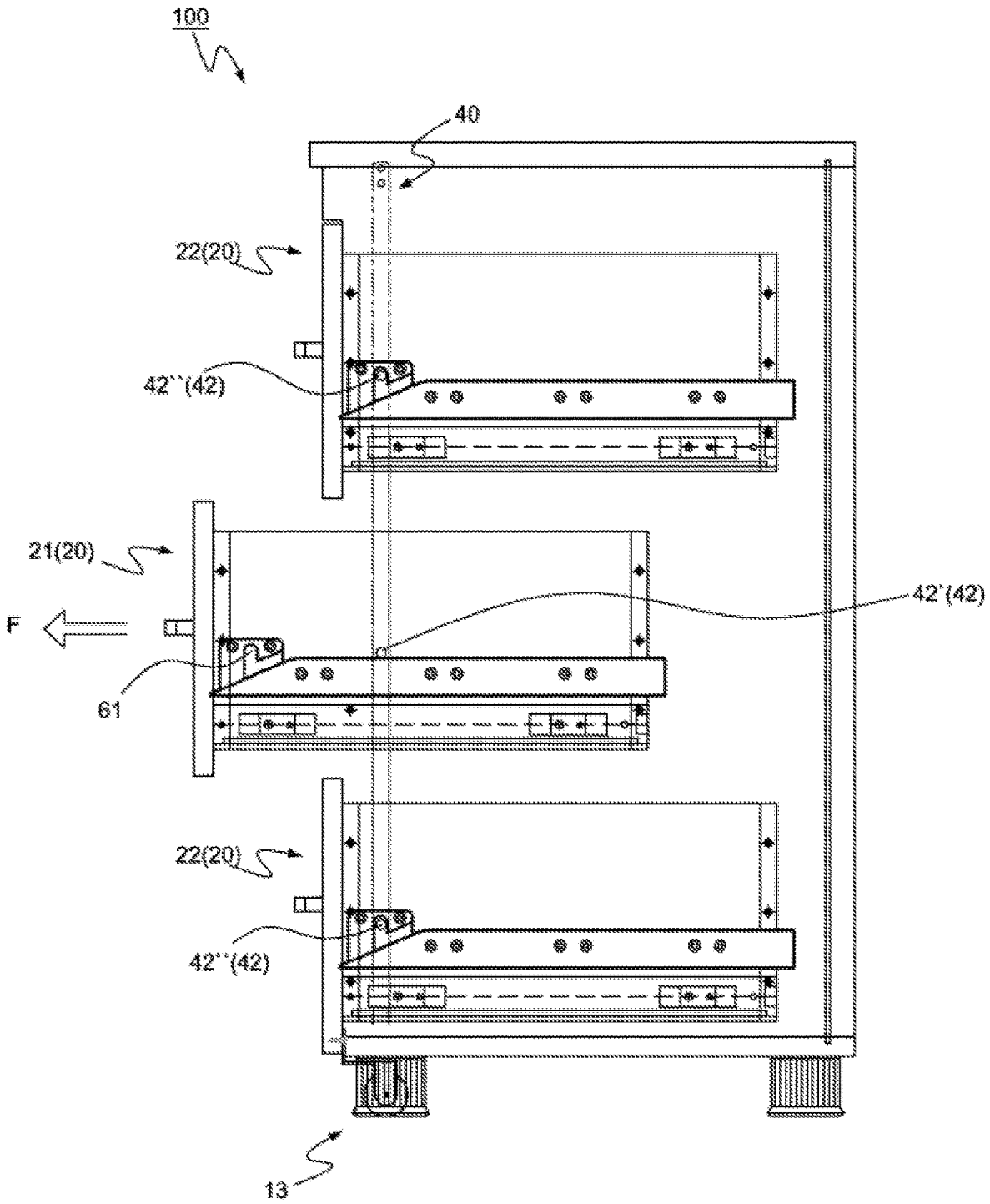
FIG. 10 is an exemplified view illustrating a state in which one drawer is extended from the storage furniture main body according to the present disclosure.
Figure 11:
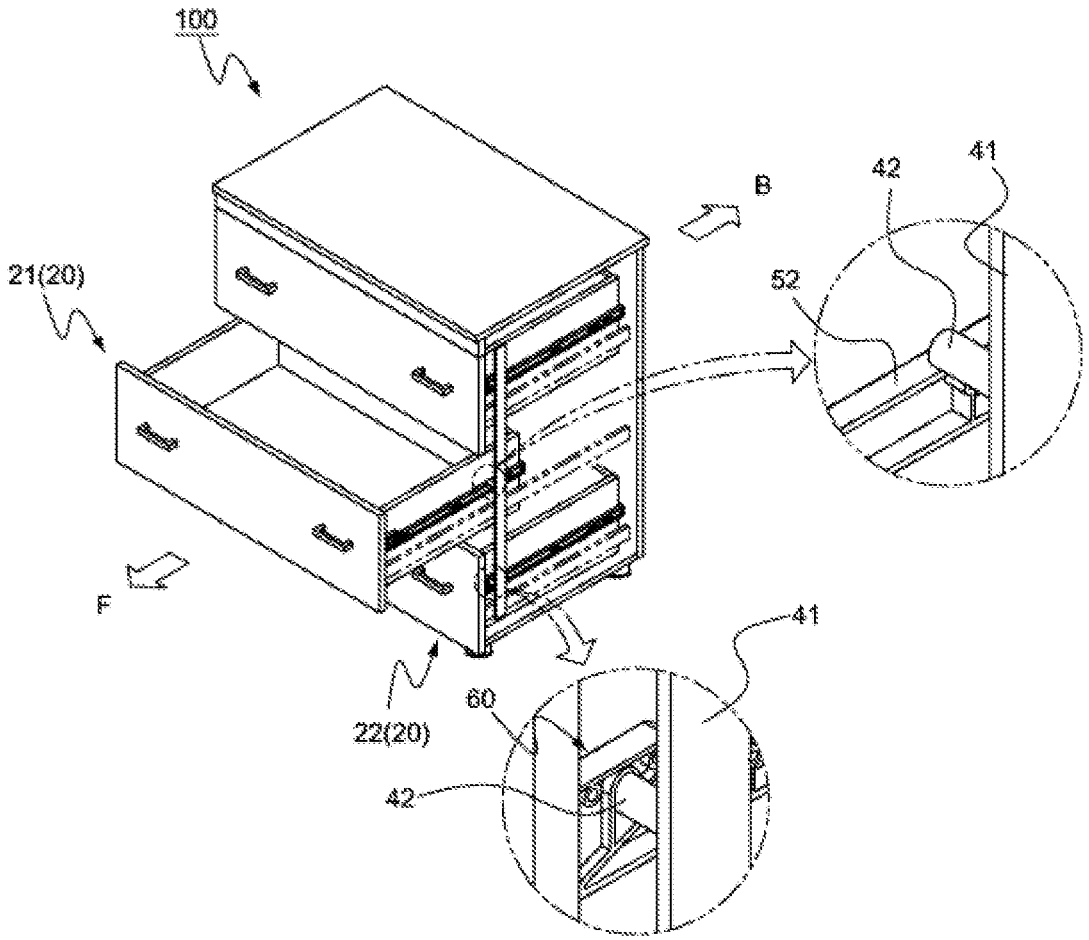
FIG. 11 is another exemplified view illustrating a state in which one drawer is extended from the storage furniture main body according to the present disclosure.

FIG. 1 is an exemplified view illustrating a configuration according to the present disclosure, FIG. 2 is an exemplified view illustrating an internal configuration of a storage furniture according to the present disclosure, FIG. 3 is an exemplified view illustrating an assembly relationship between a locking guide and a locking support according to the present disclosure, FIG. 4 is an exemplified view illustrating a configuration of a locking member of the locking support according to the present disclosure, FIG. 5 is an exemplified view illustrating a state in which the storage furniture according to the present disclosure is locked, FIG. 6 is an exemplified view illustrating a configuration of the locking guide according to the present disclosure, FIG. 7 is an exemplified view illustrating detailed configurations of a guide unit and a locking unit according to the present disclosure, FIG. 8 is an exemplified view illustrating a state in which a drawer is coupled to a storage furniture main body according to the present disclosure, FIG. 9 is an exemplified view illustrating a state in which one drawer is extended from the storage furniture main body according to the present disclosure, FIG. 10 is an exemplified view illustrating a state in which one drawer is extended from the storage furniture main body according to the present disclosure, and FIG. 11 is another exemplified view illustrating a state in which one drawer is extended from the storage furniture main body according to the present disclosure.

The present disclosure includes: a storage furniture main body 10 having an internal space 11 opened at a front side thereof; a plurality of drawers 20 installed to be extended from and retracted into the storage furniture main body 10; a locking guide 30 installed at one side of each of the drawers 20; and a locking support 40 installed vertically on one side inner surface 10*a* of the storage furniture main body so as to correspond to the locking guide 30 and having a plurality of locking members 42, in which the locking guide 30 has a guide unit 50 and a locking unit 60 which are integrally configured, the guide unit 50 changes a height of the locking member 42 in an upward/downward direction while moving in a state in which the guide unit 50 is in contact with the locking member 42 of the locking support, and the locking unit 60 is provided at a front end of the guide unit 50 so as to be connected to the guide unit 50 and has a locking groove 61 into which the locking member 42 of the locking support is inserted and coupled.

A safety storage furniture 100 according to the present disclosure may be not only a typical storage furniture having a storage furniture main body on which a plurality of drawers is installed in multiple stages to accommodate storage objects, but also a drawer unit, a cupboard, a filing cabinet, a clothing cabinet, a desk drawer, a document cabinet, a file box, or a cabinet that has two or more drawers installed to be individually extended.

The storage furniture main body 10 has the internal space 11 opened in a forward direction F and may have legs or wheels 13 installed at a lower end thereof. The plurality of drawers 20 is installed in the internal space 11 of the storage furniture main body so as to be retracted into and extended from the internal space 11.

The drawer 20 may be connected to and installed on the storage furniture main body 10 by means of a guide rail or a sliding rail 90. Because the structure in which the storage furniture main body 10 and the drawer 20 are connected and operated by means of the guide rail or the sliding rail 90 is a well-known technology widely used to extend and retract the drawer, a detailed description thereof will be omitted.

The locking support 40 is positioned between the drawer 20 and the storage furniture main body 10 and installed in the internal space 11 so as to be vertically moved in the upward/downward direction. The locking support 40 serves to lock all the drawers 20 installed in the storage furniture main body 10 to prevent all the drawers 20 from being extended. When one drawer 21 is extended, the locking support 40 serves to lock the other drawers 22 to prevent the other drawers 22 from being extended from the storage furniture main body 10.

The locking support 40 includes a vertical support member 41 installed in a height direction of the storage furniture main body 10, and the plurality of locking members protruding at a predetermined interval from the vertical support member 41.

The vertical support member 41 is connected to and installed on the storage furniture main body 10 by one or more support pieces 43 so as to be movable upward and downward and positioned in the internal space 11.

The support piece 43 serves to support and guide the vertical support member 41 so that the vertical support member 41 is vertically moved in the upward/downward direction, but the shape and the structure of the support piece 43 is not particularly limited.

For example, the support piece 43 is provided in the form of a separate bracket to support, guide, fix, and install the vertical support member on one side inner surface 10*a* of the storage furniture main body. Alternatively, the support piece 43 is formed by bending one side of the storage furniture main body in order to support and guide the vertical support member. Alternatively, the support piece 43 is formed integrally with the storage furniture main body by injection molding in order to support and guide the vertical support member.

In addition, the vertical support member 41 is inserted into a vertical guide groove 12 formed at predetermined depth in one side inner surface 10*a* of the storage furniture main body and may move along the vertical guide groove 12. The vertical support member 41 may be installed to be supported by the support piece 43 in the form of a flat plate shape. When the vertical support member 41 is inserted and installed into the vertical guide groove 12 as described above, the vertically upward and downward movements of the locking support 40 may be more stably and smoothly performed.

The locking member 42 is inserted and coupled into the locking groove 61 of the locking guide to lock the drawer 20 and prevent the drawer 20 from being extended. The plurality of locking members 42 is connected and installed onto the vertical support member 41 at a predetermined interval so as to be directed toward one side surface 20*a* of the drawer to which the locking guide 30 is connected and installed. The plurality of locking members 42 is installed to correspond to the plurality of drawers 20 installed in the storage furniture main body 10.

In this case, the locking member 42 is connected and installed onto the vertical support member 41 and has a predetermined length so that an end 42*a* of the locking member 42 may be inserted and coupled into the locking groove 61 of the locking unit without being in contact with one side surface 20*a* of the drawer.

The locking member 42 has a rod or cylindrical shape. The locking member 42 may be formed and installed integrally with the vertical support member 41 or rotatably connected and installed onto a shaft 41*a* installed on the vertical support member 41, as illustrated in FIG. 4.

In this case, the locking member 42 may have a plurality of grooves 42*c* formed in a contact surface 42*b* being rollably in contact with the locking guide 30, and the plurality of grooves 42*c* is formed in a circumferential direction, that is, a rolling direction. In the case in which the plurality of grooves 42*c* is formed in the contact surface as described above, an area of the locking member 42, which is rollably in contact with the locking guide 30, that is, the guide unit 50 of the locking guide, is decreased. As a result, during the operation of extending the drawer 20, noise caused by contact between the locking guide 30 and the locking member 42 is reduced, and a frictional force is also reduced, thereby improving performance in extending and retracting the drawer 20.

As illustrated in FIG. 5, the locking support 40, configured as described above, may be connected to and installed in the storage furniture main body 10 so as to be operated in conjunction with a manual (key) or digital (electric) key box 80. Alternatively, as illustrated in FIGS. and 2, the locking support 40 may be connected to and installed in the storage furniture main body 10 so as to be operated in conjunction with the extension and retraction of the drawer 20.

The key box 80 serves to lock the drawer 20 to prevent the drawer 20 from being opened. Because the configuration in which the locking support 40 is connected to the key box 80 and the vertical support member 40 moves upward and downward as the key box operates is a well-known technology widely used for the storage furnitures, a detailed description thereof will be omitted. FIG. 5 illustrates a state in which all the drawers of the storage furniture are locked by a manual key box.

As illustrated in FIGS. 1, 6, and 7, the locking guide 30 includes: the guide unit 50 configured to change the height of the locking member 42 in the upward/downward direction while moving in the state in which the guide unit 50 is in contact with the locking member 42 of the locking support; and the locking unit 60 provided at the front end of the guide unit 50 so as to be connected to the guide unit 50 and having the locking groove 61 into which the locking member 42 of the locking support is inserted and supported in position.

The guide unit 50 is in contact with the locking member of the locking support and serves to move the locking member 42 upward or downward during the operation of extending or retracting the drawer 20.

As illustrated in FIGS. 6 and 7, the guide unit 50 includes an inclined guide 51 configured to move the locking member 42 upward and downward, and a horizontal guide 52 extending from the inclined guide 51 and maintain a position of the locking member 42 moved upward. The guide unit 50 is disposed on one side surface 20*a* of the drawer so that based on the forward direction (the extension direction of the drawer) F of the storage furniture, the inclined guide 51 is positioned at a front end, and the horizontal guide 52 is positioned at a rear end.

The locking unit 60 is configured to have both the function of preventing the extension and the retraction of the drawer 20 by being coupled to the locking member 42 of the locking support, and the function of guiding the locking member 42 of the locking support so that the locking member 42 stably moves upward or downward along the inclined guide 51. The locking unit 60 is connected integrally to the inclined guide 51 of the guide unit.

As illustrated in FIGS. 6 and 7, the locking unit 60 is provided to extend from the front end of the guide unit, that is, the inclined guide and includes the locking groove 61 along which the locking member 42 moves in the upward/downward direction, and an inclined guide groove 62 communicating with a lower end of the locking groove 61 and formed along the inclined guide 51.

The locking groove 61 includes a vertical line cross section 61*a* extending from the inclined guide 51 and configured to guide the locking member 42 in the upward/downward direction, a locking support surface 61*b* spaced apart from the vertical line cross section 61*a* at a predetermined distance and configured such that the locking member 42 is caught by the locking support surface 61*b*, and a stopper surface 61*c* having both ends connected to the vertical line cross section 61*a* and the locking support surface 61*b* and configured to restrict the movement of the locking member 42 moved upward. A distance L from the vertical line cross section to the locking support surface is larger than a diameter D of the locking member.

In this case, the stopper surface 61*c* is formed such that a height H thereof from the horizontal guide of the guide unit is larger than the diameter D of the locking member. In addition, in a case in which the stopper surface 61*c* is formed as a curved surface having a semi-circular shape, a height H1 from the horizontal guide 52 to an apex T of the stopper surface is larger than the diameter D of the locking member. As a result, when a locking member 42' comes into contact with the horizontal guide 52 of the locking guide installed on one drawer 21 being extended, another locking member 42" is smoothly inserted and coupled into the locking groove 61 of another locking guide installed in the storage furniture.

In addition, as illustrated in FIG. 7B, the locking groove 61 may be formed such that the locking support surface 61*b* is inclined upward in a rearward direction (the retraction direction of the drawer) B toward the stopper surface 61*c*. When the locking support surface 61*b* is inclined upward as described above, the locking groove 61 has a shape convex in the rearward direction (the retraction direction of the drawer) B. As a result, when the drawer remaining in the locked state (one drawer in the state in which the locking member is inserted and coupled into the locking groove) is forcibly moved (extended) in the forward direction F by vibration or a force caused by a rollover or an external factor, the locking support surface 61*b* inclined upward comes into contact with the locking member 42 and moves downward in the forward direction, such that the locked state of the drawer 20 is more securely maintained. That is, the drawer is more assuredly prevented from being forcibly extended.

The locking guide 30, configured as described above, may be fixedly installed on one side surface 20*a* of the drawer by screws, bolts, and the like. Alternatively, the locking guide 30 may be fixedly installed by being coupled, by one-touch fitting, to a coupling bracket 20*b* provided on one side surface 20*a* of the drawer so that the inclined guide 51 and the horizontal guide 52 of the guide unit are exposed to the outside of the coupling bracket 20*b*. In this case, the guide unit 51 of the locking guide 30 may further have a fixing groove 30*a* to which the coupling bracket 20*b* is fitted and fixed.

Hereinafter, an operational relationship of the present disclosure configured as described above will be described with reference to the drawings.

FIG. 8 is an exemplified view illustrating a state in which the drawer is coupled to the storage furniture main body according to the present disclosure, FIG. 9 is an exemplified view illustrating a state in which one drawer is extended from the storage furniture main body according to the present disclosure, FIG. 10 is an exemplified view illustrating a state in which one drawer is extended from the storage furniture main body according to the present disclosure, and FIG. 11 is another exemplified view illustrating a state in which one drawer is extended from the storage furniture main body according to the present disclosure.

When any one drawer 21, among the plurality of drawers provided in the storage furniture, is extended in the forward direction F, the locking guide 30 installed on one side surface of the drawer 21 being extended is also moved in the forward direction F. The guide unit 50, i.e., the inclined guide 51 of the locking support, which is moved in the forward direction F, comes into contact with one side locking member 42' of the locking support, such that the locking member 42' is pushed upward.

As one side locking member 42' is pushed upward as described above, the entire locking support 40 is vertically moved upward. When the drawer 21 is continuously extended, one side locking member 42', which moves upward along the inclined guide 51, comes into contact with the horizontal guide 52 extending from the inclined guide 51, such that the state in which one side locking member 42' is moved upward (vertically moved) is maintained. That is, the state in which the entire locking support 40 is moved upward is maintained.

When the locking support 40 is moved upward as described above, the other locking members 42" provided on the locking support are inserted and coupled into the locking grooves 61 formed in the locking units of the remaining drawers 22, which are not extended, such that all the remaining drawers 21, which are not extended, are kept locked as the locking members 42" are coupled to the locking grooves 61. That is, when one drawer is extended, all the other drawers are kept locked.

The present disclosure is not limited to the specific embodiment described above, various modifications can be made by any person skilled in the art to which the present disclosure pertains without departing from the subject matter of the present disclosure as claimed in the claims, and the modifications are within the scope defined by the claims.

In addition, the terms used to describe the present disclosure are used only for the purpose of distinguishing one constituent element from another constituent element and assisting in understanding the present disclosure, and the constituent elements of the present disclosure should not be limited by the terms.

What is claimed is:

1. A safety storage furniture comprising:

a storage furniture main body (10) having an internal space (11) opened at a front side thereof;

a plurality of drawers (20) installed and connected by the storage furniture main body (10) so as to be extended from and retracted into the storage furniture main body (10);

a locking guide (30) installed on one side surface (20*a*) of each of the drawers (20); and a locking support (40) installed vertically on one side inner surface (10*a*) of the storage furniture main body so as to correspond to the locking guide (30) and having a plurality of locking members (42), wherein the locking guide (30) has a guide unit (50) and a locking unit (60) which are integrally configured, the guide unit (50) changes a height of the locking member (42) in an upward/downward direction while moving in a state in which the guide unit (50) is in contact with the locking member (42) of the locking support, and the locking unit (60) is provided at a front end of the guide unit (50) so as to be connected to the guide unit (50) and has a locking groove (61) into which the locking member (42) of the locking support is inserted and coupled and wherein the locking member (42) has a rod or cylindrical shape, wherein the locking member (42) is formed/installed integrally with a vertical support member (41) or rotatably connected and installed onto a shaft (41*a*) installed on the vertical support member (41), and wherein the locking member (42) has a plurality of grooves (42*c*) formed in a contact surface (42*b*) being rollably in contact with the locking guide (30), and the plurality of grooves (42*c*) is formed in a circumferential direction, such that during an operation of extending and retracting the drawer (20), noise and frictional force caused by contact between the locking guide (30) and the locking member (42) are reduced.

2. The safety storage furniture of claim 1, wherein the guide unit (50) of the locking guide comprises:

an inclined guide (51) configured to move the locking member (42) upward and downward; and a horizontal guide (52) extending from the inclined guide (51) and configured to maintain a position of the locking member (42) moved upward, wherein the guide unit (50) is disposed on one side surface (20*a*) of the drawer so that based on a forward direction of the storage furniture (F), the inclined guide (51) is positioned at a front end, and the horizontal guide (52) is positioned at a rear end, and wherein the locking unit (60) of the locking guide is provided to extend from a front end of the guide unit, that is, the inclined guide and includes the locking groove (61) along which the locking member (42) moves in the upward/downward direction, and an inclined guide groove (62) communicating with a lower end of the locking groove (61) and formed along the inclined guide (51).

3. The safety storage furniture of claim 2, wherein the locking groove (61) comprises:

a vertical line cross section (61*a*) extending from the inclined guide (51) and configured to guide the locking member (42) in the upward/downward direction;

a locking support surface (61*b*) spaced apart from the vertical line cross section (61*a*) at a predetermined distance and configured such that the locking member (42) is caught and supported by locking support surface (61*b*); and a stopper surface (61*c*) having both ends connected to the vertical line cross section (61*a*) and the locking support surface (61*b*) and configured to restrict a movement of the locking member (42), and wherein a distance (L) from the vertical line cross section to the locking support surface is larger than a diameter (D) of the locking member.

4. A safety storage furniture, comprising:

a storage furniture main body (10) having an internal space (11) opened at a front side thereof;

a plurality of drawers (20) installed and connected by the storage furniture main body (10) so as to be extended from and retracted into the storage furniture main body (10);

a locking guide (30) installed on one side surface (20*a*) of each of the drawers (20); and a locking support (40) installed vertically on one side inner surface (10*a*) of the storage furniture main body so as to correspond to the locking guide (30) and having a plurality of locking members (42), wherein the locking guide (30) has a guide unit (50) and a locking unit (60) which are integrally configured, the guide unit (50) changes a height of the locking member (42) in an upward/downward direction while moving in a state in which the guide unit (50) is in contact with the locking member (42) of the locking support, and the locking unit (60) is provided at a front end of the guide unit (50) so as to be connected to the guide unit (50) and has a locking groove (61) into which the locking member (42) of the locking support is inserted and coupled, wherein the guide unit (50) of the locking guide comprises:

an inclined guide (51) configured to move the locking member (42) upward and downward; and a horizontal guide (52) extending from the inclined guide (51) and configured to maintain a position of the locking member (42) moved upward, wherein the guide unit (50) is disposed on one side surface (20*a*) of the drawer so that based on a forward direction of the storage furniture (F), the inclined guide (51) is positioned at a front end, and the horizontal guide (52) is positioned at a rear end, and wherein the locking unit (60) of the locking guide is provided to extend from a front end of the guide unit, that is, the inclined guide and includes the locking groove (61) along which the locking member (42) moves in the upward/downward direction, and an inclined guide groove (62) communicating with a lower end of the locking groove (61) and formed along the inclined guide (51), wherein the locking groove (61) comprises:

a vertical line cross section (61*a*) extending from the inclined guide (51) and configured to guide the locking member (42) in the upward/downward direction;

a locking support surface (61*b*) spaced apart from the vertical line cross section (61*a*) at a predetermined distance and configured such that the locking member (42) is caught and supported by locking support surface (61*b*); and a stopper surface (61*c*) having both ends connected to the vertical line cross section (61*a*) and the locking support surface (61*b*) and configured to restrict a movement of the locking member (42), wherein a distance (L) from the vertical line cross section to the locking support surface is larger than a diameter (D) of the locking member, and wherein the locking groove (61) is formed so that the locking support surface (61*b*) is inclined upward in a rearward direction (B) toward the stopper surface (61*c*), such that the locking groove is convex in the rearward direction (B).

5. A safety storage furniture, comprising:

a storage furniture main body (10) having an internal space (11) opened at a front side thereof;

a plurality of drawers (20) installed and connected by the storage furniture main body (10) so as to be extended from and retracted into the storage furniture main body (10);

a locking guide (30) installed on one side surface (20*a*) of each of the drawers (20); and a locking support (40) installed vertically on one side inner surface (10*a*) of the storage furniture main body so as to correspond to the locking guide (30) and having a plurality of locking members (42), wherein the locking guide (30) has a guide unit (50) and a locking unit (60) which are integrally configured, the guide unit (50) changes a height of the locking member (42) in an upward/downward direction while moving in a state in which the guide unit (50) is in contact with the locking member (42) of the locking support, and the locking unit (60) is provided at a front end of the guide unit (50) so as to be connected to the guide unit (50) and has a locking groove (61) into which the locking member (42) of the locking support is inserted and coupled, wherein the guide unit (50) of the locking guide comprises:

an inclined guide (51) configured to move the locking member (42) upward and downward; and a horizontal guide (52) extending from the inclined guide (51) and configured to maintain a position of the locking member (42) moved upward, wherein the guide unit (50) is disposed on one side surface (20*a*) of the drawer so that based on a forward direction of the storage furniture (F), the inclined guide (51) is positioned at a front end, and the horizontal guide (52) is positioned at a rear end, and wherein the locking unit (60) of the locking guide is provided to extend from a front end of the guide unit, that is, the inclined guide and includes the locking groove (61) along which the locking member (42) moves in the upward/downward direction, and an inclined guide groove (62) communicating with a lower end of the locking groove (61) and formed along the inclined guide (51), wherein the locking guide (30) is coupled, by one-touch fitting, to a coupling bracket (20*b*) provided on one side surface (20*a*) of the drawer so that the inclined guide (51) and the horizontal guide (52) of the guide unit are exposed to an outside of the coupling bracket (20*b*), and wherein the guide unit (50) of the locking guide (30) further has a fixing groove (30*a*) to which the coupling bracket (20*b*) is fitted and fixed.

* * * * *